United States Patent [19]

Luers et al.

[11] Patent Number: 4,730,676

[45] Date of Patent: Mar. 15, 1988

[54] DOWNHOLE FOAM GENERATOR

[75] Inventors: Thomas J. Luers; Vincent G. Reidenbach, both of Duncan, Okla.

[73] Assignee: Halliburton Company, Duncan, Okla.

[21] Appl. No.: 446,924

[22] Filed: Dec. 6, 1982

[51] Int. Cl.[4] ..... E21B 43/00

[52] U.S. Cl. ..... 166/309; 261/DIG. 26; 261/78.2

[58] Field of Search ..... 166/67, 68, 105, 243, 166/300, 309, 310, 316; 261/DIG. 26, 78 A

[56] References Cited

U.S. PATENT DOCUMENTS

| | | | |
|---|---|---|---|
| 3,053,320 | 9/1962 | Steincamp . | |
| 3,090,444 | 5/1963 | Bandiroli | 261/DIG. 26 |
| 3,196,947 | 7/1965 | Van Poollen . | |
| 3,889,764 | 6/1975 | Jackson | 166/309 |
| 4,103,739 | 8/1978 | Hall . | |
| 4,330,086 | 5/1982 | Nysted | 261/DIG. 26 |
| 4,361,187 | 11/1982 | Luers . | |

*Primary Examiner*—Stephen J. Novosad
*Assistant Examiner*—William P. Neuder
*Attorney, Agent, or Firm*—James R. Duzan; Joseph A. Walkowski

[57] ABSTRACT

A method and apparatus for generating foam in a well bore, the apparatus being a foam generator comprising a tubular body having a plurality of apertures circumferentially spaced about the wall thereof, the tubular body containing a choke therein disposed above said apertures as the foam generator is positioned in the well bore. The foam generator is located in a tubing string in the well bore, preferably with at least one stand of tubing between it and the area of the well bore to be treated with the foam. The liquid component of the foam, which may or may not carry solid particles such as fracturing proppants, is pumped down the well bore annulus, while the gaseous component of the foam is introduced through the tubing string. The pressure drop across the choke and increase in gas velocity immediately therebelow in the body creates a low pressure area, into which the liquid in the annulus is drawn through the apertures in the foam generator, the resulting turbulence creating a substantially homogeneous fine-textured foam which continues down the tubing string to exit in the vicinity of the well bore to be treated.

11 Claims, 2 Drawing Figures

DOWNHOLE FOAM GENERATOR

BACKGROUND OF THE INVENTION

It is common in the petroleum industry to employ foamed liquids in cleaning out and/or fracturing wells, particularly petroleum wells with low formation pressures and gas wells. Foam is employed for a number of reasons, among them the necessity to avoid formation damage from the large hydrostatic head generated by a column of liquid in the well bore, and the desirability to conserve liquid well treating materials, the quantity thereof required being significantly reduced by foaming.

Several methods are known for generating foam for well treatment, such as generating the foam at the well head by using a TEE or pumping the treating liquid down a well bore annulus to the treatment zone while pumping a gaseous component of the foam down a tubing string which ends at the treatment zone. The former method requires very high pumping pressures in deeper wells, due to the frictional losses incurred by pumping foam. In a well with a high fracture gradient, defined as treatment pressure over treatment zone depth, such frictional losses may render foam fracturing prohibitively expensive or impossible to perform. The latter method produces an unstable foam with non-uniform bubble size and dispersion as well as "slugging" of gas and liquid, if in fact a foam per se is produced at all.

U.S. Pat. No. 3,889,764, issued June 17, 1975 to John G. Jackson, discloses a method and apparatus for producing foam downhole in a drill string, in which the liquid and gaseous components of the foam may be mixed at the surface and pumped down the string to the foam delivery apparatus above the drill bit, or may be routed to the bottom of the string through separate conduits. The foam delivery apparatus is opened and closed by a pressure-controlled valve, and the foam is generated through impingement of the gas/liquid mixture onto a knife edge located between the discharge orifices of the apparatus. The foam thus generated travels up the wellbore carrying the material dislodged by the drill bit. When the liquid and gas are mixed at the surface, high pumping pressure is required. If several conduits are employed to carry the separated components to the drill bit, this requires the unwieldy handling of both the drill pipe and two inner conduits. In either case, the knife edge generator is unsuitable for use with abrasive-laden fluids, and the use of a spring loaded control valve requires a fairly precise estimate of the foam flow desired at any given time, in order to precalculate the desired pressure drop and adjust the valve spring.

SUMMARY OF THE INVENTION

In contrast to the prior art, the downhole foam generator of the present invention produces a highly stable, fine-textured substantially uniform foam in a well bore without the necessity of a downhole valve or disposition of several conduits in the well bore. In addition, the foam generator of the present invention may be used with the proppant or other abrasive-laden fluids.

The downhole foam generator of the present invention comprises a tubular body having a plurality of apertures circumferentially spaced about the wall thereof, the tubular body containing a choke therin disposed above said apertures as the foam generator is positioned in the well bore. The foam generator is located in a tubing string in the well bore, preferably with at least one stand of tubing between it and the area of the well bore to be treated with the foam. The liquid component of the foam, which may or may not carry solid particles such as fracturing proppants, is pumped down the well bore annulus, while the gaseous component of the foam is introduced to the well bore through the tubing string. The term "liquid component" is employed as a general term; in fact, the term "liquid" is intended to encompass liquids, gels, emulsions, suspensions or slurries. Various combinations of additives may be employed in the primary liquid, such as surfactants, retarders, accelerators, inhibitors and others known to those of ordinary skill in the art. The pressure drop across the foam generator choke and increase in gas velocity immediately therebelow creates a low pressure area in the vicinity of the apertures, into which the liquid in the annulus is drawn, the resulting turbulence in the aperture area of the body and therebelow creating a substantially homogeneous fine-textured, stable foam which exits from the bottom of the tubing string in the vicinity of the well bore to be treated.

The quantity and Mitchell quality of foam generated may be easily varied at the surface of the well through change of pressures and pumping rates of the components. The foam generator of the present invention is adaptable by one of ordinary skill in the art to foaming liquids such as may be employed in acid treatments of wells, gels such as may be employed in fracturing, acidizing or fracturing/acidizing, or slurries such as cement to create a lightweight foamed cement. Thus it is apparent that a novel, unobvious and extremely versatile method and apparatus has been invented by applicants herein.

BRIEF DESCRIPTION OF THE DRAWINGS

The downhole foam generator of the present invention may be better understood by reference to the followed detailed description, taken in conjunction with the appended drawings, wherein.

DETAILED DESCRIPTION OF THE PREFERRED EMBODIMENT

Figure 1:
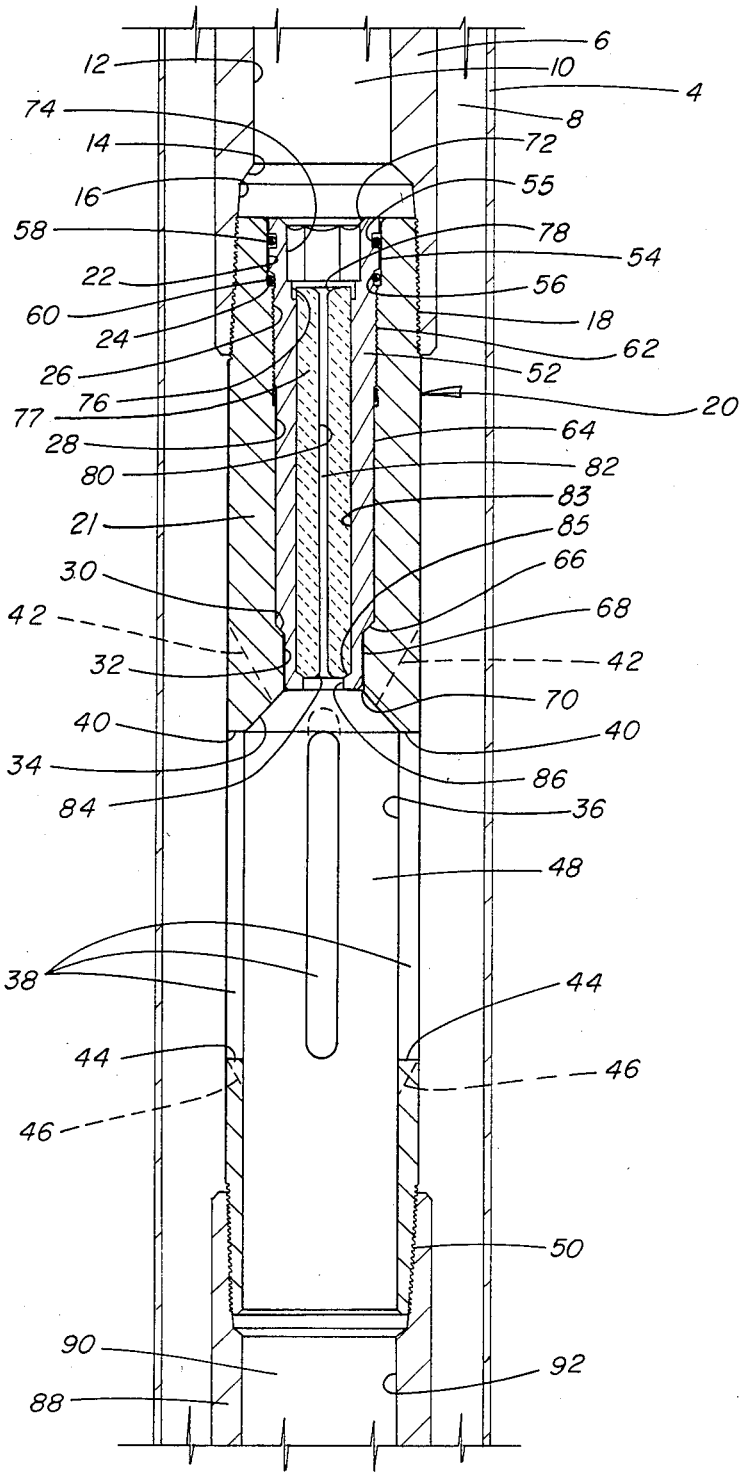
FIG. 1 is a vertical full sectional elevation of a preferred embodiment of the foam generator of the present invention, disposed in a section of a cased well bore in a tubing string.

Referring to FIG. 1 of the drawings, downhole foam generator 20 is disposed in well bore casing 4 from tubing string 6, well bore annulus 8 being defined therebetween. Inner wall 12 of tubing string 8 defines tubing string bore 10. Inner wall 12 leads to downwardly radially outwardly extending annular surface 14, which adjoins connector surfaces 16 by which the foam generator of the present invention is threaded to tubing string 6 at 18.

Foam generator 20 comprises a substantially tubular body, generally designated by reference numeral 21, having a substantially constant outer diameter below threaded connection 18. The interior of tubular body 21 comprises substantially circular entry bore wall 22, leading to radially inwardly extending annular shoulder 24, which is followed by coaxial threaded bore wall 26 extending to smooth bore wall 28. At the lower end of smooth bore wall 28, radially inwardly extending oblique annular surface 30 leads to a smaller bore, defined by smooth bore wall 32. Below smooth bore wall 32, annular surface 34 extends obliquely radially outward to bore wall 36, which is of substantially constant diameter for the remaining extent of body 21.

A plurality of apertures 38, preferably slots as shown, are circumferentially spaced about body 21 and extend from the exterior to the interior thereof. These apertures 38 may have relatively flat radially extending upper and lower extents 40 and 44, or oblique, inwardly and downwardly radially extending upper and lower extents as shown by broken lines identified by reference numerals 42 and 46. The latter configuration may be more suitable for use with abrasive-laden fluids, as the former may result in erosion of the aperture edges. It is desirable but not necessary that the total aperture area be equal to or greater than the cross-sectional area of the well bore annulus between the tubing string 8 and well bore casing 4.

Bore wall 36 defines substantially unobstructed foaming chamber 48, which extends to the bottom of body 21, whereat one or more tubing stands 88 may be threaded thereto at 50, the bore 90 thereof being defined by tubing bore wall 92.

Choke means 52 is disposed within foam generator body 21. Choke means 52 comprises substantially cylindrical outer wall 54 having annular recess 55 cut therein. At the lower extent of outer wall 54, annular undercut 56 leads to threaded outer wall 62, which in turn leads to smooth outer wall 64. Below outer wall 64, inwardly extending oblique annular surface 66 leads to a smaller diameter wall 68, which terminates at lower surface 70 of choke means 52.

The interior of choke means 52 comprises annular oblique surface 72, leading downwardly and inwardly to hexagonal socket 74, below which is circular bore wall 76, ending at an annular step (unnumbered) extending to choke insert bore 83, which terminates at oblique annular step 85, which in turn leads to reduced diameter termination bore 86.

Choke cartridge 77, of substantially cylindrical configuration, is secured within choke insert bore 83. Choke cartridge 77 as shown comprises a ceramic material, and possesses curved annular entrance and exit surfaces communicating with substantially coaxial choke bore 82, as defined by circular choke bore wall 84. However, a variety of materials may be employed in fabricating choke cartridge 77. A variety of choke cartridges 77, with varying choke bores 82, may be employed in choke means 52 to provide a variety of gas flows and pressure drops in foam generator 20, for a given pumping pressure. Also, if desired, choke means 52 may be made in one piece, of a single material.

Choke means 52 is secured to foam generator body 21 by insertion therein, threaded wall 26 of foam generator body 21 engaging threaded wall 62 of choke means 52, choke means 52 being threaded into body 20 until surface 66 engages surface 30.

A seal between choke means 52 and body 21 is effected by annular elastomeric seals 58 and 60. Choke means 52 is threaded into body 20 through use of an Allen wrench in hexagonal socket 74.

OPERATION OF THE PREFERRED EMBODIMENT

Figure 2:
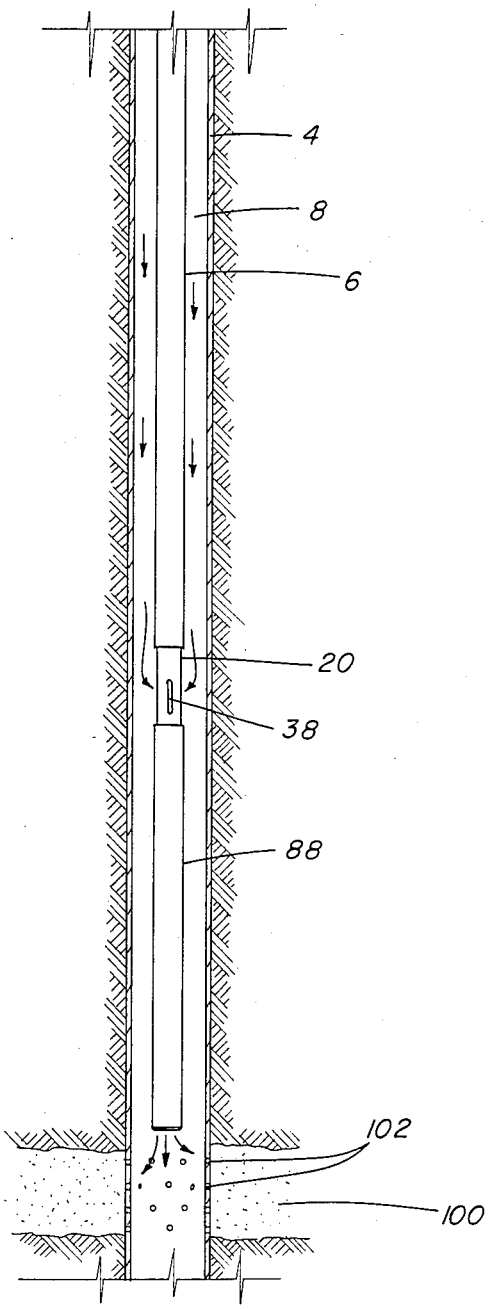
FIG. 2 is a semi-schematic partial section of a cased well bore having a tubing string suspended therein, the foam generator of the present invention being disposed in the tubuing string above a zone to be treated with the generated foam.

Referring to FIGS. 1 and 2, the operation of the preferred embodiment of the foam generator of the present invention is hereafter described.

In FIG. 2, the exterior of foam generator 20 is depicted disposed from tubing string 6 in casing 4 in a well bore. The remainder of the tubing string is designated by reference numeral 88, as in FIG. 1. Zone 100 of the well is to be treated through perforations 102 in casing 4. Portion 88 of the tubing string is not necessary, but at least one stand of tubing below foam generator 20 is desirable to further stabilize the generated foam prior to contact with zone 100. The treatment may comprise fracturing, acidizing, a combination thereof, or any other treatment which may employ a foamed liquid, emulsion, suspension, gel, or slurry. Of course, the foam generator may also be employed to generate a foamed cement to seal an annulus between a well bore wall and outer casing.

Referring now to FIGS. 1 and 2, to commence the treatment operation, the gaseous component of the foam is pumped down bore 10 of tubing string 8, to foam generator 20. The liquid component is pumped down well bore annulus 8 to foam generator 20, at which point it is pulled into foam generator 20 through apertures 38 due to the operation of choke means 52, which increases the gas velocity as it passes through choke bore 80, and consequently decreases the pressure of the gas. As liquid is pulled into foaming chamber 48, it impinges the gas stream exiting from choke bore 80, the resulting turbulence creating a foam from the liquid and gaseous components. Below foam generator 20, the foam created in foaming chamber 48 stabilizes in the tubing 88 therebelow, until the foam exits in the vicinity of formation 100, penetrating it through perforations 102. As noted previously, it is desirable but not necessary that the area of apertures 38 be greater than that of the cross-sectional area of the annulus between the tubing string 8 and well bore casing 4, so as to further promote the entry of fluid into foam generator 20.

By way of illustration and not limitation, the following example is indicative of the results which may be achieved utilizing the foam generator of the present invention.

Using a foam generator designed for $2\frac{7}{8}''$ upset tubing and a volumetric nitrogen flow of 15 barrels per minute (bpm) and a liquid flow rate of 5 bpm, a 75 Mitchell quality foam and a total flow rate of 20 bpm was attempted, the mass flow rate of nitrogen or the SCFM required being a function of the bottom hole treating pressure. The required flow rate of nitrogen for a particular quality foam increases with increasing bottom hole pressure. The pressure drop across the choke will also increase with increasing nitrogen flow rate, creating a greater pressure differential between the annulus and the foaming chamber of the foam generator. The choke employed may be a ceramic production choke which is commercially available for an LT-10 or LT-20 production manifold; a choke bearing Halliburton Services Part Number 643.034 having an orifice size of three-quarters of an inch was employed in this example.

By way of reference to prior art methods in a first test, foam was initially generated using fresh water as a base fluid at the surface of the well using a TEE in the line leading to the tubing. Throughout the test, a gel was mixed using 40 lb of WG-11 guar gum base gelling agent per 1000 gallons of total fluid, WG-11 being available from Halliburton Services, Duncan, Okla. This gel had a viscosity of 40 cp at a temperature of 46° F. A surfactant (Howco Suds, also available from Halliburton Services) was employed at a rate of 4 gallons/1000 gallons total fluid. A constant mass ratio of nitrogen to gel was used in all the tests, of 580 SCF/bbl. In the well itself, 283 feet of 2 ⅞" tubing was initially employed inside 5½" casing run to a depth of 294 feet, surrounded by 9⅝" casing plugged at a depth of 327 feet. A pinch valve was installed on a foam return line out of the well and used as a choke to set a desired system back pressure. A sign glass was also installed across the pinch valve in the return line to observe foam characteristics. Foam was produced on the surface with the TEE in the line and forced down the tubing at a back pressure of 610 PSI, then returned to the surface via the well bore annulus between the 5½" and 9⅝" casing. 1055 PSI nitrogen pressure and 1055 PSI gel pressure were required to generate the above noted back pressure. A 60 Mitchell quality foam was produced at the TEE and a 70 Mitchell quality foam was observed in the return from the well. Visual observation of the foam under pressure in a sight glass indicated that it was fine-textured and substantially homogeneous. The descriptive term "fine-textured" may also be expressed as the gaseous component of the foam having a relatively small bubble size, a desirable characteristic which contributes to foam stability and more uniform dispersion of the fluid component of the foam.

A second foam generation test using the same gel composition, surfactant concentration and nitrogen to gel mass ratio was employed using another prior art method. In this test, nitrogen was pumped down 283 feet of tubing and gel down the annulus between the tubing and 5½" casing allowing the two to mix below the end of the tubing. The pinch valve setting was not changed from the first test, resulting in a back pressure of 550 PSI. Foam quality was noted as 72 on the Mitchell scale, and 700 PSI nitrogen pressure with 710 PSI gel pressure resulted from not having to pump foam down the tubing. However, the foam as observed in the sight glass was full of slugs or large bubbles of gas, and was much less homogeneous and less stable than that generated in the TEE.

In a third test, the downhole foam generator of the present invention was placed in the tubing at a depth of 251 feet, with 31 additional feet of tubing below. Using the same gel composition, surfactant concentration and mass ratio as in the previous tests, nitrogen was pumped down the tubing and gel down the annulus between the tubing and 5½" casing. At the same pinch valve setting as in previous tests, back pressure was 570 PSI, and both nitrogen and gel pressure at the surface were 750 PSI, with a substantially homogeneous, fine-textured stable foam of 70 Mitchell quality observed in the sight glass. Several other similar tests were run, with the foam generator located further up in a tubing string and with more tubing below it. With the foam generator at a depth of 126 feet and 95 feet of tubing therebelow, 800 PSI nitrogen pressure and 810 PSI gel pressure were observed, and a foam of 70 Mitchell quality produced. At a depth of 31 feet, and with a 252 feet of tubing below it, the foam generator produced a nitrogen pressure of 825 PSI and a gel pressure of 855 PSI, and a foam of 70 Mitchell quality. The foam generated in these latter tests was also substantially homogeneous, of a fine texture and high stability. These latter two tests also indicated that foam was in fact being produced at the foam generator, as the surface pressure at the nitrogen and gel pumps increased notably each time the generator was moved upward in the tubing, the pressure increases being due to the increased frictional losses involved in pumping the generated foam a greater distance.

It will be noted from the results of the above tests, that the downhole foam generator produced a foam of comparable texture, homogeneity and stability to that generated by use of a TEE at the surface, while reducing pumping pressures by 20 to 30 percent, with a resulting decrease in required hydraulic horsepower, and thus expense, of a foam fracturing or cleanout job. An increase in the depth at which the foam generator is placed results in a decrease of pumping pressures due to the reduction in frictional losses. In the same vein, these test results indicate that it is possible, using the foam generator of the present invention, to fracture deep wells with large fracture gradients using a foam without incurring the prohibitive pumping losses associated with generating foam at the surface and pumping it down to the treatment zone. In addition, it was shown that the foam generator of the present invention produces substantially more stable, homogeneous and fine-textured foam than the prior art expedient of pumping nitrogen down tubing and gel down the well bore annulus, at little pressure increase penalty.

Thus it has been shown that novel and unobvious method and apparatus for the generation of foam in a well bore has been disclosed. Certain additions, deletions and modifications of the method and apparatus of the present invention will be apparent to one of ordinary skill in the art without departing from the spirit and scope of the claimed invention.

We claim:

1. Apparatus for generation of foam in a well bore, comprising:

tubing means disposed in said well bore;

a well bore annulus surrounding said tubing means;

a liquid in said well bore annulus;

a pressurized gas in said tubing means;

foam generator means including tubular body means having gas choke means associated therewith, adapted to communicate with the bore of said tubing means and receive said pressurized gas therefrom, aperture means through the wall of said body means adapted to direct said liquid from said well bore annulus into said foam generator means below said gas choke means, and foaming chamber means defining a bore having no physical obstruction disposed therein below said aperture means.

2. The apparatus of claim 1, further including second tubing means affixed to said tubular body means of said foam generator means and in communication with the bore thereof below said foaming chamber means.

3. The apparatus of claim 1, wherein said aperture means comprises a plurality of circumferentially spaced apertures in the wall of said tubular body means.

4. The foam generator of claim 3, wherein said plurality of apertures comprise a plurality of longitudinally extending slots.

5. The foam generator of claim 4, wherein said slots possess oblique upper and lower edges oriented radially downwardly and inwardly.

6. The apparatus of claim 1, wherein said gas choke means comprises a plurality of removable choke cartridges having different bore diameters and adapted to be inserted into said tubular body means, whereby the degree of choke may be changed by changing said cartridges.

7. The apparatus of claim 1, wherein said well bore is lined with casing means, said well bore annulus is defined between said casing means and said tubing means, and the area of said aperture means is equal to or greater than the cross-sectional area of said annulus.

8. The foam generator of claim 1, wherein said gas choke means comprises a substantially axial restricted bore through said body means.

9. A method of generating foam in a well bore, comprising:

disposing tubing means in said well bore;

disposing foam generator means having aperture means through the wall thereof from said tubing means;

pumping a liquid down the annulus defined by said tubing means and the wall of said well bore;

pumping a gas stream down said tubing means into said foam generator means;

increasing the velocity of said gas and lowering the pressure thereof substantially adjacent said aperture means;

drawing said liquid through said aperture means into turbulent impingement on said gas stream; and generating a foam substantially solely through said turbulent impingement of said liquid on said gas stream.

10. The method of claim 9, further comprising disposing second tubing means in said well bore from said foam generator means.

11. The method of claim 10, further comprising stabilizing said foam in said second tubing means.

* * * * *